United States Patent [19]

Hailer et al.

[11] Patent Number: 4,731,284

[45] Date of Patent: Mar. 15, 1988

[54] THERMALLY BONDABLE ROOFING MATERIAL

[75] Inventors: Dieter Hailer, Düsseldorf; Kurt Schult, Dorsten, both of Fed. Rep. of Germany

[73] Assignee: Dr. Kohl GmbH & Cie Dachbelag- und Bautenschutzmittel Fabrik, Dorsten, Fed. Rep. of Germany

[21] Appl. No.: 921,673

[22] Filed: Oct. 21, 1986

[51] Int. Cl.[4] ..... B32B 9/00; B32B 11/00; B32B 3/10; B65B 63/00

[52] U.S. Cl. ..... 428/291; 52/518; 428/136; 428/139; 428/141; 428/143; 428/167; 428/179; 428/352; 428/489

[58] Field of Search ..... 428/291, 489, 139, 136, 428/141, 143, 167, 179, 352; 52/518, 519

[56] References Cited

U.S. PATENT DOCUMENTS

| | | | |
|---|---|---|---|
| 3,607,589 | 9/1971 | Schirtzinger | 428/291 X |
| 4,136,223 | 1/1979 | Harder | 428/139 |
| 4,389,064 | 6/1983 | Laverriere | 428/136 X |
| 4,472,243 | 9/1984 | Bondoc et al. | 428/291 X |
| 4,567,079 | 1/1986 | Canfield et al. | 428/291 X |
| 4,617,221 | 10/1986 | von der Chys | 428/291 X |

FOREIGN PATENT DOCUMENTS

| | | | |
|---|---|---|---|
| 3113391 | 1/1983 | Fed. Rep. of Germany | 428/291 |

*Primary Examiner*—George F. Lesmes
*Assistant Examiner*—D. R. Zirker
*Attorney, Agent, or Firm*—Karl F. Ross; Herbert Dubno

[57] ABSTRACT

A roof covering material is comprised of a polybitumen sealing web composed of a thermally weldable closed homogeneous sealing layer formed along an underside with parting and pressure equalizing means affording fluid communication over an internal region of juxtaposition of the web with a roof surface, and a support of a filamentary web impregnated with a polymerbitumen on an upper surface of the substantially fluid-impermeable web.

10 Claims, 4 Drawing Figures

THERMALLY BONDABLE ROOFING MATERIAL

FIELD OF THE INVENTION

Our present invention relates to a thermally bondable roofing material and, more particularly, to a thermally weldable strip of polymerbitumen which can be applied to a roof surface and on which adjoining strips can be thermally welded together to form a complete roof covering shielding the roof surface from the environment. The invention especially relates to a polymerbitumen weldable band for the covering of roofs and which comprises a sealing layer of polymerbitumen which is substantially fluid impermeable and which forms a composite with a carrier of filamentary material, such as a glass fiber or filament fabric, a fleece, especially a glass fiber fleece, or a screen or grid, e.g. of glass fiber or like filamentary material.

BACKGROUND OF THE INVENTION

The provision of polymerbitumen strip for roof covering, utilizing the fact that adjoining strips of the roof covering can be thermally welded together, have generally made use of a carrier layer or insert, also referred to as a fiber reinforcement layer or blanket, which consists of a chemical fiber fleece, a glass fabric, glass fleece or the like which is covered by upper and lower sealing layers of polymerbitumen so that the carrier or the support can be found in the middle third of the sealing layer.

Such conventional weldable strips have the disadvantage that the upper and lower cover layers can easily pull away from the carrier so that the sealing layer itself is split. As a consequence the strips do not conform to the industrial standards for effective roof coverings and cannot assure the sealing of the roof surface to which they are applied.

Generally a fine gravel, e.g. of crushed slate, is applied as a protective layer to the upper cover layer of such roof coverings and, as a consequence, the penetration of sharp edges of gravel tends to destroy this upper cover layer.

Furthermore, when a cover layer of the aforedescribed type is provided above the reinforcement layer which is impregnated with the polymerbitumen, the gravel tends to spring away from the roof covering during the heating which results in the welding of the seam between adjoining strips of the roof covering causing a problem in the overlap or seam regions and presenting a danger to the workers applying the roof covering.

Furthermore, since gravel may be incorporated in the overlap region and the seam, a homogeneous bonding of two strips together in such overlap region is practically impossible.

OBJECTS OF THE INVENTION

It is, therefore, the principal object of the present invention to provide an improved roof covering material which obviates the drawbacks outlined above and not only permits an improved seal to be made in the roof covering, but also ensures an increased useful life of the roof.

Another object of this invention is to provide an improved roofing material which nevertheless is of comparatively low cost and can be laid on the roof surface with comparative ease and speed.

Still another object of this invention is to provide an improved roof structure utilizing the new roofing material.

It is also an object of this invention to provide an improved method of forming such a roof structure.

SUMMARY OF THE INVENTION

These objects and others which will become apparent hereinafter are attained, in accordance with the invention by providing the thermally weldable roofing material or strip with a closed homogeneous sealing layer upon the upper surface of which the reinforcement web of chemical or mineral fibers and impregnated with polymerbitumen is provided, and whose underside is formed as a separating and equalizing layer, i.e. with means affording fluid communication over at least an internal region overlain by the roof covering material so that this means provides a separating and vapor-pressure equalizing structure.

The sealing layer which is substantially fluid impermeable and is composed of polymerbitumen, according to the invention, can be thermally bondable to the adjoining strip and can have a thickness of, for example, 4 mm while the carrier impregnated with polymerbitumen can have a thickness of about 1 mm.

With this construction, the roof covering material provides an especially effective bond at the thermal welds at which the strips overlap, as a consequence of the homogeneous nature of the sealing layer.

In addition, the carrier not only provides a supporting function which improves the sealing effect therebelow, but affords mechanical protection to the sealing layer from above and protection against solar radiation as well as shocks resulting from strong temperature differentials. The aging resistance of the strip is likewise improved by the upper support layer which is impregnated with polymerbitumens.

According to a feature of the invention, the separating and vapor distribution and pressure equalizing layer can be a system of channels which can be formed by intersecting longitudinal and transverse grooves. The channel system can be coated with talc or some other parting agent to prevent undesired bonding to the roof surface or a foil, e.g. of a low adhesion synthetic resin or a metal can be applied to this layer and can extend into the grooves for a similar purpose. The channel system thus ensures vapor pressure equalization practically over the entire roof surface because the grooves of the overlapping strips can communicate with one another. This has been found to be particularly advantageous when high amounts of moisture are generated in the structure although it is also effective when normal levels of moisture may be released.

The channel system can also be formed by projections from the parting (antibonding) and pressure equalizing layer in a bristle or like pattern, e.g. as an array of relatively closely spaced and comparatively short studs formed unitarily on the latter layer and having a spacing which may be equal approximately to the stud width. The studs can have heights of 4 to 5 mm which can likewise be the dimension of the stud width or diameter and the stud separation.

The projections, as noted, are preferably of the same material as forms the sealing layer and provide a relatively high volume of free space between the roof surface and the sealing layer as has been found to be especially effective in washing sheds, laundries, automobilewashing installations and the like where large amounts of moisture are generated.

According to a further feature of the invention, the sealing layer may be provided along one of its longitudinal and/or transverse edges or both of them, with planar adhesive borders for the overlapping bonding of adjacent strips. These flat edges can be free from longitudinal and transverse grooves for the aforementioned projections so that a flat contact of overlapping edge portions of the strips can be ensured. The weld sealing the edge strips together is therefore more effective than would be the case if the grooves or projections reached to the edge regions.

The polymerbitumen weldable strips forming the roof covering of the present invention thus constitute an especially long life roof surfacing even when used in the manner of single layer high polymer strips as have been employed heretofore.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
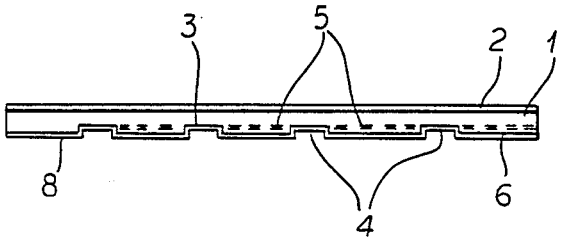
FIG. 1 is an elevational view from the short edge of a polymerbitumen weldable strip provided with a channel system according to one embodiment of the invention.

FIG. 1 shows a closed homogeneous sealing layer 1 of polymerbitumen on the upper surface of which a support or reinforcement 2, preferably of woven glass fabric, nonwoven glass fiber fleece or a glass screening mat of one or more layers, as represented at 2, is applied. Before the support 2 is applied to the homogeneous sealing layer 1, the support 2 is impregnated by soaking it in the polymerbitumen before the latter is permitted to congeal.

As can be seen from FIG. 1, the sealing layer 1 is formed on its underside with a channel system 3 consisting of mutually intersecting longitudinal grooves 4 and transverse grooves 5. The underside is, moreover, covered with a continuous or discontinuous foil 6 of a low-adhesion material, e.g. polytetrafluoroethylene or metal or is coated with talc as indicated at 6, this foil extending into the grooves 4 and 5 and preferably continuously covering the underside of the sealing layer. As a consequence, the channel system 3 together with the parting (antibonding) surface, forms a highly effective separating and vapor-pressure equalizing layer.

Figure 2:
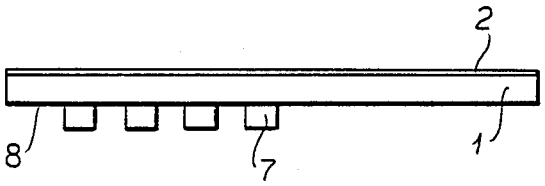
FIG. 2 is an elevational view from the short side of another polymerbitumen weldable strip, in this case having a surface array of projections.

The underside of the sealing layer 2 shown in FIG. 2 is provided with a nap-like array of projections 7 with a height of 4 to 5 mm so that interstices between these projections allows distribution of the vapor pressure. These projections can be treated with the parting foil or a coating of talk as described and the projections 7 can be composed of the same material as forms the sealing layer.

In both of the embodiments, edge portions 8 can be provided which are free from the projections 7 or the grooves 4, 5 to allow flat contact between overlapping edge portions which can be heat-sealed together to provide especially effective roof coverings. A completed roof covering is shown at 10 in FIG. 3 on a roof surface and comprises two strips 11 and 12, each of which has an impregnated carrier layer 13 overlying a homogeneous closed polymerbitumen sealing layer 14.

At one edge of each of the strips, the channels, e.g. the channels 5 can extend to the edge of the strip as shown for the strip 11 whereas the channels 5 can terminate short of the sealing edge 8 of the strip, as can be seen for the strip 12, so that a flat weld seam as represented at 15 can be provided without interference from either the channels or the projections.

Figure 3:
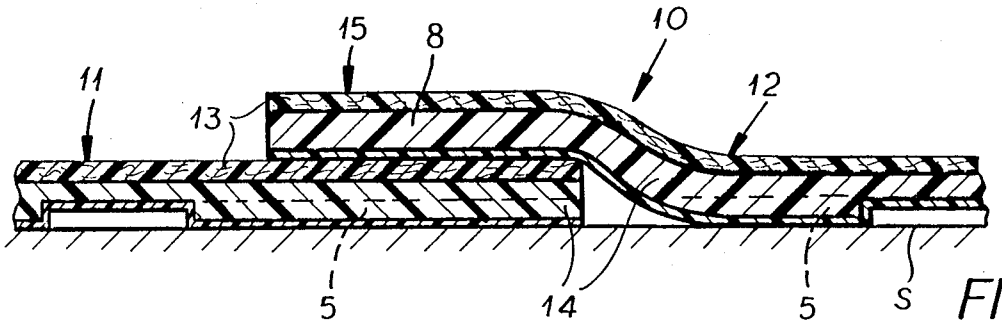
FIG. 3 is a cross-sectional view illustrating the junction between two strips forming a roof covering.
Figure 4:
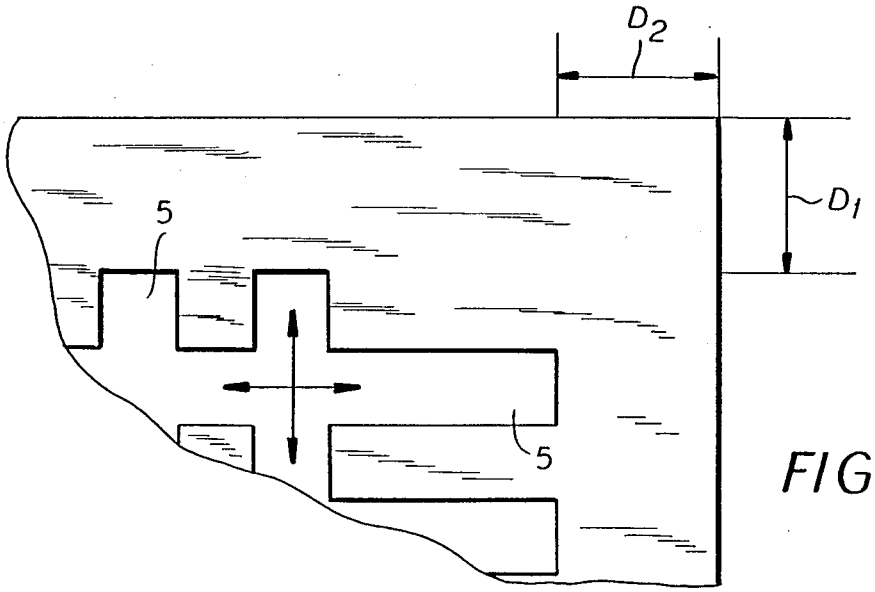
FIG. 4 is a view of the underside of a strip in accordance with the invention.

The groove array 4,5 is shown for a strip in FIG. 4 which has edge zones of widths $D_1$ and $D_2$ at which seals can be provided, as may be desirable. It is preferred, however, to have the grooves communicate as shown in FIG. 3 over the entire surface of the roof coverings.

We claim:

1. A roof covering material comprising a polybitumen sealing web composed of:
   - a thermally weldable closed homogeneous sealing layer formed along an underside with antibonding means and pressure equalizing means for affording fluid communication over an internal region of juxtaposition of said web with a roof surface; and
   - a support of a filamentary web impregnated with a polymerbitumen on an upper surface of said substantially fluid-impermeable web,
     - said pressure-equalizing means including means forming a channel system along the underside of said sealing layer which consists of mutually intersecting longitudinal and transverse grooves formed in said sealing layer, and
     - said antibonding means including a layer covering said underside and resisting adhesion to the roof surface.

2. The roof covering material defined in claim 1 wherein said sealing layer is covered on its underside with a foil of polytetrafluoroethylene or metal forming said antibonding means and resisting adhesion to the roof service and extending into said surface.

3. The roof covering material defined in claim 1 wherein said pressure-equalizing means includes a nap-like array of projections on the underside of said sealing layer.

4. The roof covering material defined in claim 4 wherein said projections are formed of the same material as said sealing layer.

5. The roof covering material defined in claim 1 wherein said web is formed along at least one of its longitudinal and transverse edges with a flat border adapted to sealingly engage an adjoining web.

6. A roof comprising:
   - a roof surface; and
   - a plurality of strips of a roof covering material overlying and covering said surface, each of said strips comprising:
     - a polybitumen sealing web composed of:
     - a thermally weldable closed homogeneous sealing layer formed along an underside with antibonding means and pressure for equalizing means affording fluid communication over an internal region of juxtaposition of said web with a roof surface; and said pressure-equalizing means including means forming a channel system along the underside of said sealing layer which consists of mutually intersecting longitudinal and transverse grooves formed in said sealing layer and said antibonding means including a layer covering said underside and resisting adhesion to the roof surface, and a support of a filamentary web impregnated with a polymerbitumen on an upper surface of said substantially fluidimpermeable web, adjoining strips being overlapped and heat sealed together to prevent penetration of fluids to said surface, the pressure equalizing means of adjoining strips forming intercommunicating channels such that said channels communicate with one another substantially over the entire roof.

7. The roof defined in claim 6 wherein said sealing layer is covered on its underside with a foil of polytetrafluoroethylene or metal forming said antibonding means and resisting adhesion to the roof service and extending into said surface.

8. The roof defined in claim 7 wherein said pressure-equalizing means includes a nap-like array of projections on the underside of said sealing layer.

9. The roof defined in claim 7 wherein said projections are formed of the same material as said sealing layer.

10. The roof defined in claim 7 wherein said web is formed along at least one of its longitudinal and transverse edges with a flat border adapted to sealingly engage an adjoining web.

* * * * *